US007104161B2

(12) United States Patent
De Waal

(10) Patent No.: US 7,104,161 B2
(45) Date of Patent: Sep. 12, 2006

(54) ENGINE VALVE ADJUSTMENT DEVICE

(76) Inventor: Peter De Waal, 11964 Allegheny St., Sun Valley, CA (US) 91352

( * ) Notice: Subject to any disclaimer, the term of this patent is extended or adjusted under 35 U.S.C. 154(b) by 158 days.

(21) Appl. No.: 10/977,201

(22) Filed: Oct. 29, 2004

(65) Prior Publication Data

US 2006/0090604 A1 May 4, 2006

(51) Int. Cl.
*B25B 13/48* (2006.01)
*B25B 23/14* (2006.01)
*F01L 1/14* (2006.01)

(52) U.S. Cl. ..... 81/9.24; 81/54; 81/467; 123/90.52

(58) Field of Classification Search ..... 81/9.24, 81/54, 467, 473; 7/170, 165, 100; 123/90.52, 123/90.45

See application file for complete search history.

(56) References Cited

U.S. PATENT DOCUMENTS 1,544,520 A 6/1925 Putrow
2,561,407 A 7/1951 Palmer
2,601,796 A 7/1952 Palesh, Jr.
3,932,904 A * 1/1976 Nilsson et al. ..... 7/158
4,107,800 A * 8/1978 Jorgensen ..... 7/158
4,229,999 A * 10/1980 Rottigni ..... 81/9.24
4,866,801 A 9/1989 Lamar
5,352,231 A 10/1994 Brumfield et al.
6,450,072 B1 * 9/2002 Koester ..... 81/476
6,668,688 B1 * 12/2003 Zhao et al. ..... 81/439
2005/0205035 A1 * 9/2005 Hathaway et al. ..... 123/90.52

* cited by examiner

*Primary Examiner*—Lee D. Wilson
*Assistant Examiner*—Alvin J. Grant
(74) *Attorney, Agent, or Firm*—Koppel, Patrick & Heybl; Michael J. Ram

(57) ABSTRACT

A combination of tools for use in adjusting the valves in an internal combustion engine, and particularly the movement of the valve contacting end of a rocker arm in a motorcycle engine, comprises a socket, a hollow rod sized to fit in the opening in the top of the socket and a screw driver sized to fit through an upper opening in the rod so that the valve adjustment screw can be adjusted while the locking nut thereon is easily unlocked using the socket.

7 Claims, 3 Drawing Sheets

ENGINE VALVE ADJUSTMENT DEVICE

The application relates to a device for use in adjusting the valves in an internal combustion engine and particularly the movement of the valve contacting end of a rocker arm in a motorcycle engine.

BACKGROUND

Typical internal combustion engines include one or more intake and/or exhaust valves at each cylinder in the cylinder head. Means are provided to permit quantities or air/fuel mixtures to enter a combustion chamber. The exhaust valves open to allow combustion products to exit the combustion chamber. The timing of the opening and closing of these valves, and the area of the exhaust space between the chamber and the valve when opened are variables which are mechanically adjusted to obtain good fuel burning and maintain appropriate pressure in the combustion chamber. The valve stems extend outward through the cylinder head. Resting on or above the external end of each valve stem is one end of a pivotally mounted rocker arm. A second end of the rocker arm is operatively connected to a push rod and/or a cam shaft. Movement of the push rod or cam shaft causes the rocker arm to move in an actuate path (rock) around its pivot point, in turn pushing the valve stem downward, causing the valve to move down (open). A spring arrangement typically causes the valve to close when the rocker arm rotates upward away from the valve stem. The amount of movement of the valve, and its ability to seal the chamber, is usually controlled by adjustment of an adjustment screw (valve adjuster stem) and locking nut (valve adjuster lock nut) combination, also referred to as tappet adjustment, mounted within the end of the rocker arm and in contact with the top of the valve stem or the push rod or both as the arm rotates downwardly.

One of the fundamental problems in adjusting valve clearance is the difficulty of manipulating the adjustment screw and locking nut, particularly because of the confined space in which the mechanic must operate and the tendency of the adjustment screw to move during tightening of the locking nut. Typically, the locking nut must be grasped by a wrench, loosened and held in that loosened position while the screw is adjusted and a gap between the valve stem and screw bottom is being set using a gap gauge. The nut must then be tightened while the screw is held fixed so the adjustment (the desired gap) does not change.

U.S. Pat. No. 4,229,999 to Rottigni describes a valve adjustment tool which includes an elongated barrel having a bore therethrough, an externally threaded upper barrel and an integral collet which forms a valve lock nut socket on the lower end of the barrel. The collet is surrounded by a compression collar. An elongated internally threaded sleeve is placed over the barrel abutting the compression collar. Threading the sleeve downward on the barrel compresses the collet. An elongated valve adjuster driver is placed through the bore of the barrel. This driver has a large disc shaped knob at its upper end and an engagement lug at its lower end. When assembled the collet locks on the adjustment nut so that the nut can be loosened and tightened and the driver is used to turn the adjustment screw.

U.S. Pat. No. 1,544,520 shows a one piece tool for simultaneously grasping the locking nut and turning the adjustment screw.

U.S. Pat. No. 2,601,796 shows a third example of a tool used for tappet adjustment. It includes a sleeve member for gripping the locking nut, a hollow socket member which slides onto and grips the shaft of the sleeve member and a screw driver placed through the center of the socket member to engage the adjustment screw. The sleeve member is held stationary during the adjustment process by a conventional box wrench.

Each of these prior tool assemblies have multiple components that make the adjustment process cumbersome. The valve adjustment tool described herein simplifies the adjustment process and allows the user to simultaneously measure, adjust clearances and lock the tappet assembly in the new adjusted state. A user can untighten and tighten a valve stem lock nut and adjust and simultaneously measure clearances without removing the tool from engagement with the lock nut during the adjustment, measuring and locking procedure.

DETAILED DESCRIPTION

To obtain a proper balance between engine power and minimized unburned fuel in the exhaust of an engine the timing and extent of movement of the valves in the combustion chambers of an internal combustion engine between the time of ignition and exhaust should be properly adjusted. This patent is directed to a tool assembly for adjustment of the valve movement. Adjustment of the valve movement on an automotive engine, also referred to as tappet adjustment, can be readily accomplished if the correct combination of tools is available.

Figure 1:
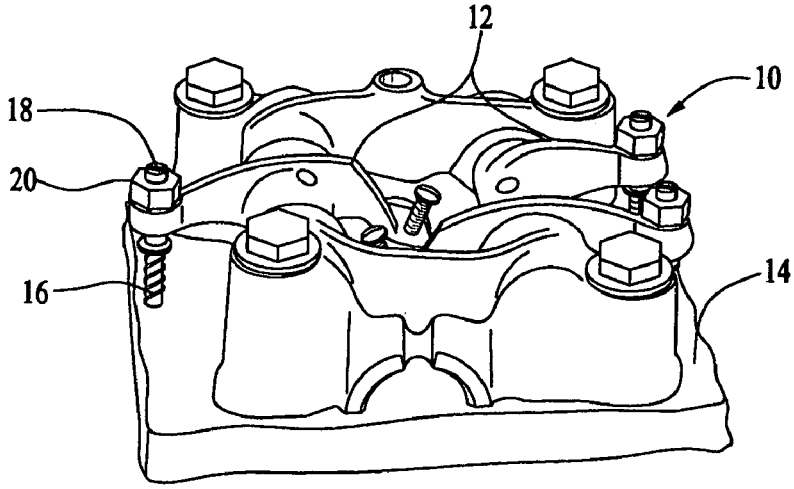
FIG. 1 shows a representative rocker arm assembly attached to the exterior of an engine block.

For reference purposes, a rocker arm assembly 10 showing two rocker arms 12 as they appear mounted to surface 14 of an engine block of a 1982 Honda CM400T motorcycle engine is shown in FIG. 1. However, one skilled in the art will recognize that the combination of components shown and described herein for performing tappet valve adjustment on the illustrated Honda engine are applicable to a broad range of engines as well as other mechanical devices which incorporate an adjustment screw with locking nut arrangement.

Figure 2:
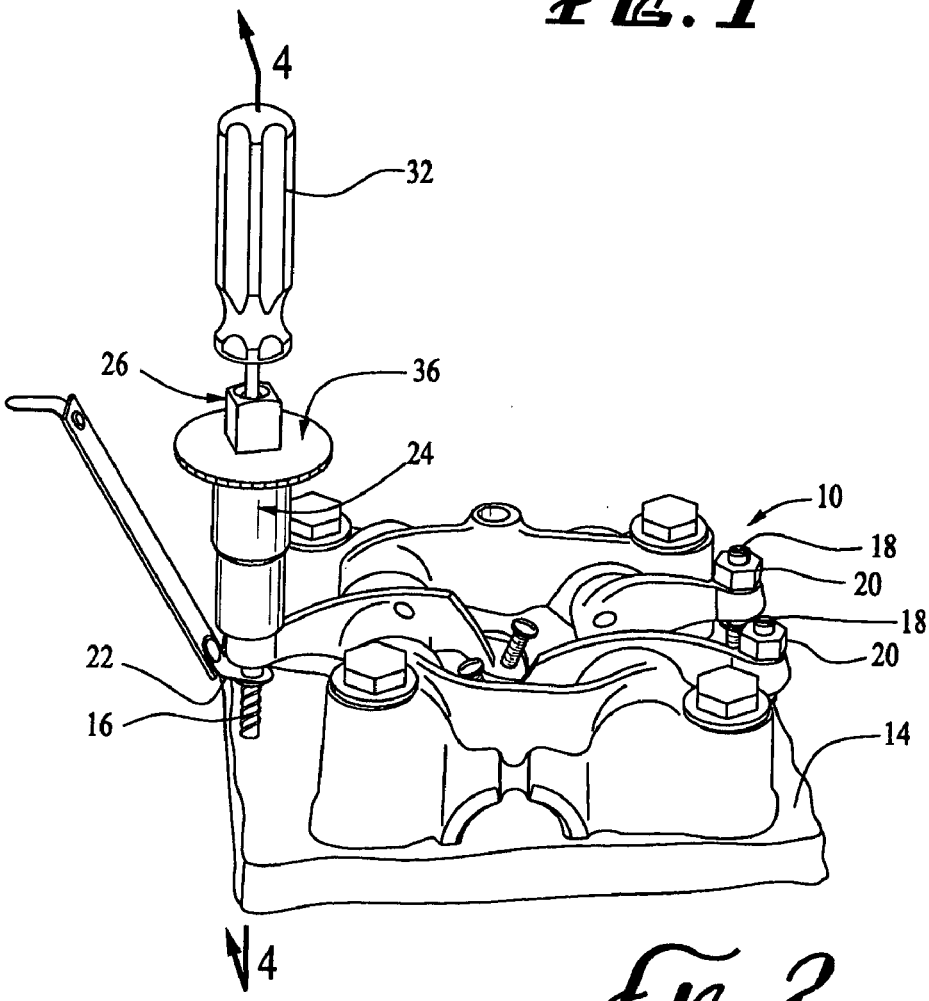
FIG. 2 shows the rocker assembly of FIG. 1 with a tappet adjustment assembly incorporating features of the invention applied thereto.
Figure 3:
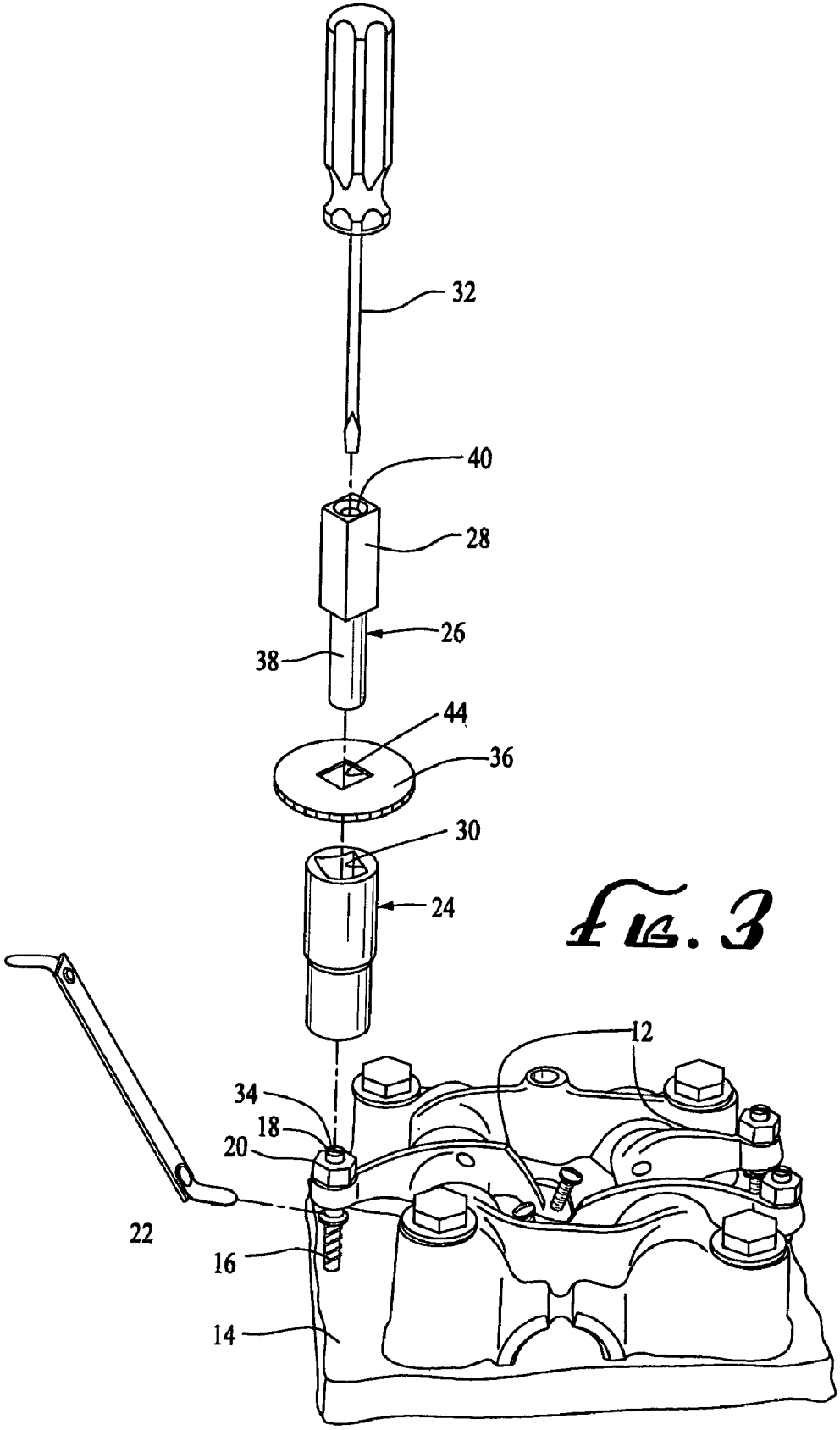
FIG. 3 an expanded view of the tappet adjustment assembly of FIG. 2 applied to a rocker arm assembly.
Figure 4:
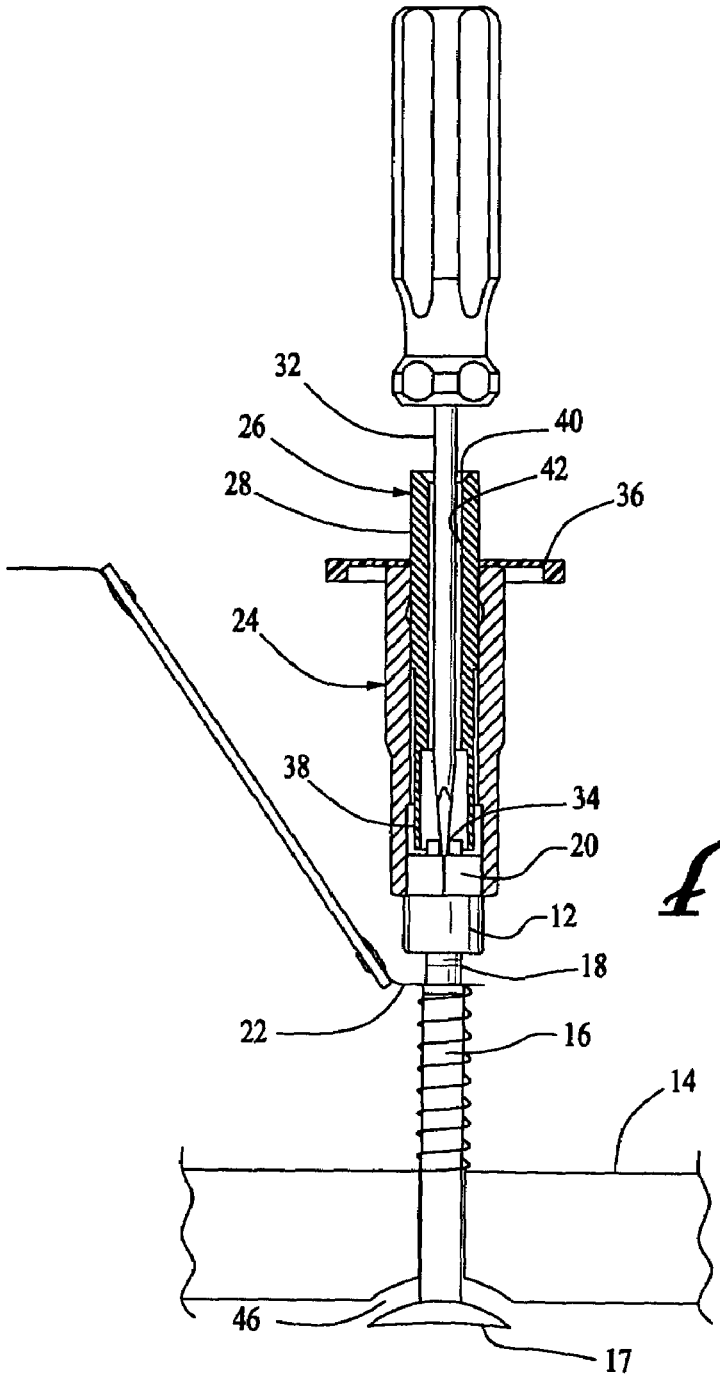
FIG. 4 is a cutaway view of the tappet adjustment assembly taken along line 4—4 of FIG. 2.

A combination of tools, incorporating features of the invention is shown in FIGS. 2–4. This combination of tools is intended to simplify and control the placement of a predetermined gap between the top of a valve stem 16 when the valve 17 is in its upper or closed position and the bottom of an adjustment screw 18 positioned in one end of a rocker arm 12 which is positioned to control the extent of opening of the valve 17. This in turn sets the extent of movement of the valve stem 16 and, as a result, the open area 46 provided when the valve 17 is in the exhaust position as shown in FIG. 4. Performing the adjustment requires loosening a locking nut 20, placing a fixed thickness gap gauge 22 between the top of the valve stem 16 and the rocker arm adjustment screw 18, adjusting the screw 18 to set the desired gap, typically from about 0.002 to about 0.003 mm, and then tightening the locking nut 20 without changing the gap just set using the adjustment screw 18. This can be problematic because the locking nut 20 is typically loosened using a socket wrench, the wrench is removed so that the adjustment screw 18 can be adjusted, and then the wrench is reapplied to tighten the nut 20. Use of a socket wrench does not allow the adjustment screw 18 to be held fixed using a screw driver while the nut 20 is being tightened. As a result the adjustment screw 18 setting (the gap) is often changed when the nut 20 is tightened.

The combination of tools, incorporating features of the invention, comprises a socket 24 chosen to fit the locking nut 20, a hollow rod 26 sized to fit in the opening in the top of the socket 24 and around the top of the adjustment screw 18, and a screw driver 32 sized to fit through the rod upper opening 40 of the lumen 42 extending through the hollow rod 26 and into a slot 34 in the top of the of the adjustment screw 18. The hollow rod 26 has an upper portion 28 with a square configuration along its length so that the lower end of the upper portion 28 fits into and matches the socket upper opening 30, typically a ⅜" or ½" square, in the socket 34. The lower portion 38 of the hollow rod 26 preferably has a circular cross-section. The socket 24, gap gauge 22 and the screw driver 32 are tools typically used in the tappet adjustment procedure. However, the hollow rod 26 and its configuration is a unique feature of the invention. An additional component which may be included is a disk 36, which preferably has an outer corrugated edge for easy grasping, and a central opening 44 sized to match the upper portion 28 of the hollow rod 26.

The dimensions of a preferred hollow rod 26 for use with a socket having a ⅜" upper opening in adjustment of the Honda CM 400T shown in FIG. 1 has a length approximately 2 inches long, comprising an upper portion 28 and a lower portion 38 each about 1 inch long with a lumen 42 therethrough having an inner diameter at its lower end of about 0.25 inches and a wall thickness of about 1/32 inches at said lower end. The upper portion may have the same or larger inner diameter, but a smaller inner diameter of about 3/16" is preferred so that a screw driver 32, with a typical maximum width at the tip or shank of less then about 3/16" when placed through is easily centered above and placed in the slot 34 in the adjusting screw 18 during the adjustment procedure. The top of the rod upper opening 40 may also be chamfered to a wider diameter. One skilled in the art will recognize that the dimensions above stated are suitable for the rocker assembly shown but different engines or different sized sockets may require different dimensions to suit the dimensions of the locking nut 20 and adjustment screw 18.

To use a tappet adjustment assembly incorporating features of the invention the locking nut 20 is loosened using a suitable tool (i.e. socket wrench, adjustable wrench, box wrench, pliers, etc.). A socket 24 appropriately sized to fit the locking nut 20 is placed over the nut, the hollow rod 26 is placed through the socket 24 with the lower end thereof surrounding the top of the adjustment screw 18, the disc 36 is placed over the upper portion 28 of the rod 26 and an appropriately sized screw driver 32 is placed into and through the rod upper opening 40. With the valve 17 positioned in its upper closed position, the desired thickness gap gauge 22 is also placed between the bottom of the adjustment screw 18 and the top of the valve stem 16. Rotating the disc 36 will cause the socket 24 to rotate, loosening or tightening the locking nut 20. The screw driver 32 with tip resting in the slot 34 in the top of the adjustment screw 18 can then be used to turn the screw 18 to set the gap and while the gap is maintained by holding the screw driver 32 so it does not rotate, the disc 36 is rotated to tighten and lock the adjustment screw 18 in its preset position. All of the adjustment tool components can then be removed and the locking nut further tightened by using a typically nut tightening tools, for example, a wrench handle or torque wrench in combination with or torque wrench into the socket 20.

While the tappet adjustment tool assembly is described in regard to a specific engine with specific dimensioned components, one skilled in the art will recognized, based on the teachings herein, the variations in dimensions and configuration of the various component can be selected without straying from the inventive concepts set forth herein. Also, the locking nut/screw adjustment tool and procedure taught herein applies to a broad range of mechanical devices which incorporate similar structure and require adjustment to maintain a fixed gap between mechanical components. It is also recognized that a socket with upper end opening having a configuration specifically designed to mate with the upper portion of the hollow rod may also be used, the square ⅜" or ½" upper opening not being a required limitation.

I claim:

1. A tool assembly for tappet adjustment in an internal combustion engine using a gap gauge wherein the tappet adjustment requires rotation of an adjustment screw and a locking nut mounted thereon, said tool assembly comprising:

a socket having a first end opening sized to fit over the locking nut and in contact with the locking nut so that rotating the socket causes the locking nut to rotate, the socket having an upper opening of a non-circular cross-section sized to receive means for rotating the socket around its central axis, wherein the means for rotating the socket around its central axis is a hollow rod having a first and second portion, the first portion insertable into the upper opening of the socket, an opening in the end of the first portion of the hollow rod having an internal diameter sized to fit over the adjustment screw without interfacing with rotation of the adjustment screw, the second portion having an outer non-circular cross-section sized and configured to fit in the non-circular upper opening of the socket, the hollow rod having a lumen centrally located through the first and second portion to allow placement of a tool there through for rotation of the adjustment screw.

2. The tool assembly of claim 1 further including a disc with a centrally located opening having a non-circular cross-section sized and configured to fit over the upper portion of the hollow rod such that rotation of the disc around its central axis will cause the hollow rod to rotate around its central axis, in turn causing the socket to rotate and turn the locking nut mounted on the adjustment screw.

3. The tool assembly of claim 1 wherein the upper opening of a non-circular cross-section in the socket is a square cross-section and the non-circular cross-section of the hollow rod is a square cross-section of a dimension to fit within the upper opening in the socket.

4. The tool assembly of claim 2 wherein the opening in the disk of a non-circular cross-section has a square cross-section of substantially the same dimensions as the upper opening in the socket.

5. The tool assembly of claim 2 wherein the hollow rod first portion has a circular cross section, the hollow rod second portion has a square cross-section, the first portion having a length such that when the hollow rod is inserted in the upper opening in the socket at least a length of the second portion also is inserted in the upper opening in the socket.

6. A method of tappet adjustment in an internal combustion engine using a gap gauge wherein the tappet adjustment requires rotation of an adjustment screw and a locking nut mounted thereon comprising:

placing a socket over the locking nut and around the adjustment screw, the socket having a lower end sized to substantially match the dimensions of the locking nut and providing contact with the locking nut sides to effect rotation the locking nut, the socket having a non-circular upper opening to receive a tool for rotating the socket around a socket central axis, the socket having a central, longitudinal opening therethrough, placing a rod having a central lumen therein through the central, longitudinal opening in the socket with a lower opening in the rod positioned around the adjustment screw in a non-interferring manner and a rod upper portion resting at least partially within the non-circular upper opening of the socket, the rod upper portion having a non-circular cross-section substantially matching the upper opening in the socket, placing means on the upper portion of the rod suitable for causing rotation of the hollow rod around a central axis therethrough, placing a screw driver through the central lumen in the rod, the tip of the screw driver being positioned in a slot in the top of the adjustment screw, placing a gap gauge between the top of a valve stem and the bottom of the adjustment screw, turning the means on the upper portion of the rod to cause the locking nut to loosen, turning the adjustment screw using the screw driver inserted into said adjustment screw slot to set a gap between the top of a valve stem and the bottom of the adjustment screw, the gap being defined by the gap gauge, and turning the means on the upper portion of the hollow rod to cause the locking nut to tighten, securing the adjustment screw with the gap defined by the gap gauge.

7. The method of claim 6 wherein the means on the upper portion of the rod suitable for causing rotation of the hollow rod around its central axis is a disc having a non-circular central opening substantially matching the non-circular cross-section of the upper portion of the rod.

* * * * *

UNITED STATES PATENT AND TRADEMARK OFFICE

CERTIFICATE OF CORRECTION

PATENT NO. : 7,104,161 B2
APPLICATION NO. : 10/977201
DATED : September 12, 2006
INVENTOR(S) : Peter De Waal It is certified that error appears in the above-identified patent and that said Letters Patent is hereby corrected as shown below:

In claim 1, col. 4, line 37, replace “interfacing” with --interfering--.

Signed and Sealed this

Fifth Day of December, 2006

JON W. DUDAS
*Director of the United States Patent and Trademark Office*